US007629947B2

(12) United States Patent
Akiyama et al.

(10) Patent No.: US 7,629,947 B2
(45) Date of Patent: Dec. 8, 2009

(54) PLASMA DISPLAY PANEL AGING METHOD

(75) Inventors: Koji Akiyama, Osaka (JP); Masaaki Yamauchi, Osaka (JP); Takashi Aoki, Osaka (JP); Koji Aoto, Hyogo (JP)

(73) Assignee: Panasonic Corporation, Osaka (JP)

( * ) Notice: Subject to any disclaimer, the term of this patent is extended or adjusted under 35 U.S.C. 154(b) by 506 days.

(21) Appl. No.: 10/566,156

(22) PCT Filed: May 24, 2005

(86) PCT No.: PCT/JP2005/009830

§ 371 (c)(1),
(2), (4) Date: Jan. 27, 2006

(87) PCT Pub. No.: WO2005/117056

PCT Pub. Date: Dec. 8, 2005

(65) Prior Publication Data

US 2006/0284795 A1 Dec. 21, 2006

(30) Foreign Application Priority Data

May 25, 2004 (JP) ..... 2004-154297

(51) Int. Cl.
*G09G 3/28* (2006.01)

(52) U.S. Cl. ..... 345/60; 445/6

(58) Field of Classification Search ..... 345/60, 345/77–79; 315/169.4; 445/24, 6; 313/514
See application file for complete search history.

(56) References Cited

U.S. PATENT DOCUMENTS 7,173,374 B2 * 2/2007 Yoo ..... 313/583
2002/0008680 A1 * 1/2002 Hashimoto et al. ..... 345/63
2004/0070575 A1 * 4/2004 Sugimoto et al. ..... 345/204

FOREIGN PATENT DOCUMENTS

JP 9-251841 A * 9/1997

(Continued)

OTHER PUBLICATIONS

JP-09-251841-A Machine Translation.*

*Primary Examiner*—Amr Awad
*Assistant Examiner*—Liliana Cerullo
(74) *Attorney, Agent, or Firm*—Wenderoth, Lind & Ponack, L.L.P.

(57) ABSTRACT

Disclosed here is a method of aging a plasma display panel. The aging method of the present invention contains a first aging period and a second aging period. In the first aging period, applying voltage Vd1 to at least any one of the scan electrodes, the sustain electrodes, and the address electrodes suppress self-erase discharge that occurs in the wake of aging voltage generated by application of voltage in which the scan electrodes take a voltage level higher than the sustain electrodes. In the second aging period, applying voltage Vd2 to at least any one of the scan electrodes, the sustain electrodes, and the address electrodes suppress self-erase discharge that occurs in the wake of aging voltage generated by application of voltage in which the sustain electrodes take a voltage level higher than the scan electrodes.

The above aging method offers a power-efficient aging process with the aging time accelerated.

2 Claims, 7 Drawing Sheets

FOREIGN PATENT DOCUMENTS

| | | | |
|---|---|---|---|
| JP | 2000-148083 | | 5/2000 |
| JP | 2002-75206 | | 3/2002 |
| JP | 2002-75208 | | 3/2002 |
| JP | 2002-231141 | | 8/2002 |
| JP | 2004-241365 | | 8/2004 |
| JP | 2004273441 A | * | 9/2004 |
| JP | 2004-363008 | | 12/2004 |
| WO | 2004/075235 | | 9/2004 |

* cited by examiner

PLASMA DISPLAY PANEL AGING METHOD

This application is a U.S. National Phase application of PCT International Application PCT/JP2005/009830.

TECHNICAL FIELD

The present invention relates to a method of aging a plasma display panel.

BACKGROUND ART

A plasma display panel (hereinafter referred to as a PDP) is a display device with a large screen, a low-profile, a light-weight body, and excellent visibility. A difference in discharging divides PDPs into two types of the alternative current (AC) type and the direct current (DC) type. In terms of the structure of electrodes, the PDPs fall into the 3-electrode surface discharge type and the opposing discharge type. In recent years, the dominating PDP is the AC type 3-electrode surface discharge PDP by virtue of having higher resolution and easier fabrication.

Generally, such a PDP contains a front plate and a back plate oppositely disposed with each other, and a plurality of discharge cells therebetween. The front plate consists of a front glass substrate, scan electrodes and sustain electrodes which form display electrodes and are disposed on the front glass substrate. A dielectric layer and a protecting layer are formed to cover the display electrodes. On the other hand, the back plate consists of a back glass substrate and the address electrodes are formed on the back glass substrate so as to be orthogonal to the display electrodes. The address electrodes are covered with a dielectric layer, and over which, barrier ribs are formed in parallel with the address electrodes. Furthermore, phosphor layers are formed between the barrier ribs and on the surface of the dielectric layer. Discharge cells are formed at each intersection of the display electrodes and the address electrodes.

In the manufacturing process of PDPs, scan electrodes and sustain electrodes and other necessary components are disposed on a front glass substrate as a front plate; similarly, address electrodes and other necessary components are disposed on a back glass substrate as a back plate. The front and back plates are oppositely positioned so that the scan electrodes and the sustain electrodes are orthogonal to the address electrodes, and then hermetically sealed on the peripheries. After that, a discharge space between the two plates is filled with discharge gas. A PDP is thus fabricated.

In driving a PDP, application of voltage for providing the entire PDP with uniform lighting (hereinafter, operating voltage) is required. In such a PDP that has just finished the assembly process, generally, the operating voltage is too high, and the discharge itself is in an unstable condition. The PDP therefore undergoes aging in the manufacturing process to lower the operating voltage and obtain consistent and stable discharge characteristics of each discharge cell.

For aging PDPs, a method—in which anti-phased rectangular waves are applied to the scan electrodes and the sustain electrodes for a long period of time—has conventionally been employed. To shorten the time for aging, some methods have been suggested. For example, Japanese Patent Unexamined Publication No. 2002-231141 introduces a method in which discharge is generated between the scan electrodes and the address electrodes in addition to the discharge between the scan electrodes and the sustain electrodes. Specifically, pulse voltage having different polarity is applied to the scan electrodes and the sustain electrodes, and at the same time, pulse voltage having a polarity the same as that applied to the sustain electrodes is applied to the address electrodes.

Even employing the methods above, the aging time still requires about 10 hours before completion of aging, that is, before obtaining preferably low operation voltage and stabilized discharging. The long aging time inevitably increases power consumption in the aging process, which has been a leading cause of increasing the running cost of manufacturing PDPs. Besides, the time-consuming aging process has caused problems: the factory space for keeping the PDPs for the aging process, and environmental conditions, such as air-conditioning, for properly maintaining the PDPs through the manufacturing process. From now on, further increase in manufacturing volumes and screen-sizes of the PDP apparently swells up the problems above and invites serious conditions.

DISCLOSURE OF THE INVENTION

The present invention addresses the problem above. It is therefore the object of the present invention to provide a method of aging PDPs capable of shortening the aging time and improving power efficiency.

To achieve the object, the method of aging PDPs contains a first aging period in which at least any one of the scan electrodes, the sustain electrodes, and the address electrodes undergo an application of voltage for suppressing a self-erase discharge that follows an aging discharge generated by application of voltage in which the scan electrodes carry a voltage level higher than the sustain electrodes; and a second aging period in which at least any one of the scan electrodes, the sustain electrodes, and the address electrodes undergo an application of voltage for suppressing a self-erase discharge that follows an aging discharge generated by the application of voltage in which the sustain electrodes carry a voltage level higher than the scan electrodes.

DETAILED DESCRIPTION OF CARRYING OUT OF THE INVENTION

In a method of aging a plasma display panel with scan electrodes, sustain electrodes, and address electrodes, in which voltage is applied to at least the scan electrodes and the sustain electrodes, the aging method contains a first aging period and a second aging period. In the first aging period, applying voltage to at least any one of the scan electrodes, the sustain electrodes, and the address electrodes suppresses self-erase discharge that occurs in the wake of the aging discharge generated by the application of voltage in which the scan electrodes take a voltage level higher than the sustain electrodes. In the second aging period, applying voltage to at least any one of the scan electrodes, the sustain electrodes, and the address electrodes suppresses self-erase discharge that occurs in the wake of the aging discharge generated by the application of voltage in which the sustain electrodes take a voltage level higher than the scan electrodes.

According to the aging method of the present invention, the second aging period can be shorter than the first aging period.

The exemplary embodiments of the present invention are described hereinafter with reference to the accompanying drawings.

First Exemplary Embodiment

Figure 1:
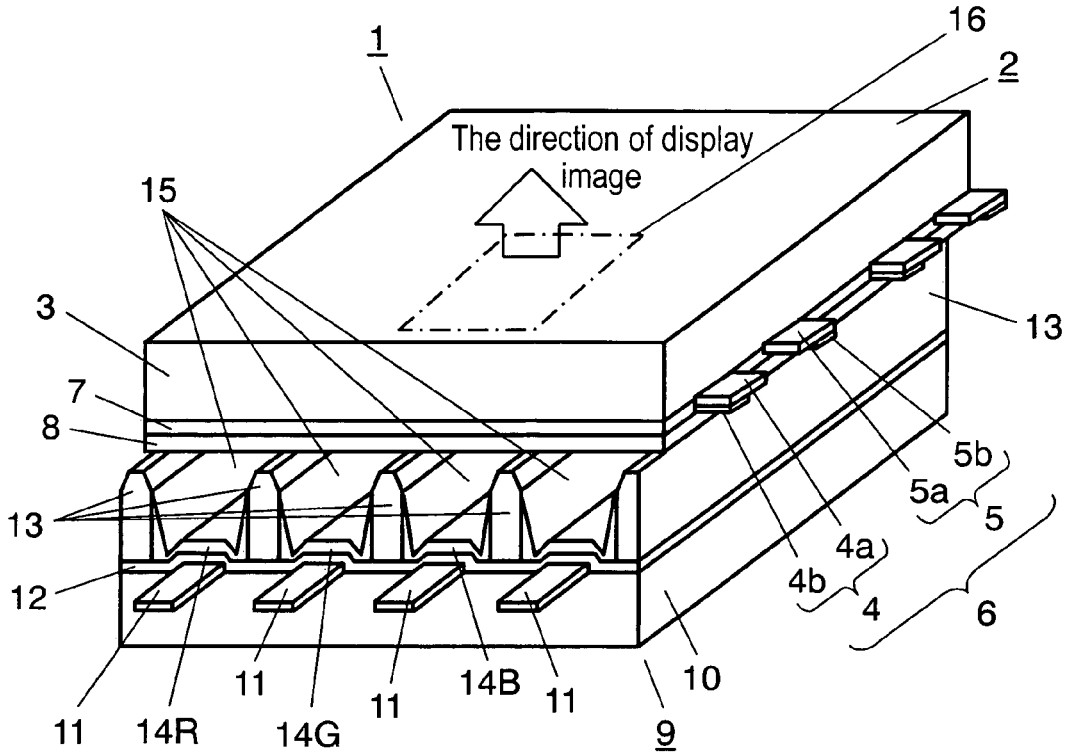
FIG. 1 is a perspective view partially showing a plasma display panel of an embodiment of the present invention.

FIG. 1 is a perspective view partially showing a PDP of the first exemplary embodiment of the present invention.

Front plate 2 of PDP 1 is completed through the following process: prepare smooth, transparent insulating substrate 3, such as a glass substrate; form a plurality of display electrodes 6, which is formed of scan electrodes 4 and sustain electrodes 5 having discharge gap therebetween, on substrate 3; form dielectric layer 7 so as to cover display electrodes 6; form protective layer 8 over dielectric layer 7. For example, float glass can be employed for substrate 3. Each scan electrode 4 is formed of transparent electrode 4*a* with broad width, and bus electrode 4*b* with narrow width disposed on transparent electrode 4*a*. Similarly, each sustain electrode 5 is formed of transparent electrode 5*a* with broad width, and bus electrode 5*b* with narrow width disposed on transparent electrode 5*a*. Transparent electrodes 4*a* and 5*a* are made of indium-tin oxide (ITO) and the like, whereas bus electrodes 4*b* and 5*b* are made of a laminated structure of chromium-copper-chromium (Cr/Cu/Cr) or made of silver (Ag) and the like. Dielectric layer 7 is formed of a glass material having a low melting point. Protective layer 8 is for protecting dielectric layer 7 from damage caused by plasma, and therefore is made of, for example, magnesium oxide (MgO).

Back plate 9 is completed through the following process: prepare insulating substrate 10 like a glass substrate; form a plurality of address electrodes 11 on substrate 10; form dielectric layer 12 so as to cover address electrodes 11; form barrier ribs 13 in parallel with address electrodes 11 in a manner that address electrodes 11 are located between adjacent barrier ribs; form phosphor layers 14R for emitting red (R), 14G for emitting green (G), and 14B for emitting blue (B) in the order named on dielectric layer 12 between adjacent barrier ribs 13.

Such structured front plate 2 and back plate 9 are oppositely located so that display electrodes 6 are orthogonal to address electrodes 11 and discharge space 15 is formed therebetween. Discharge space 15 is filled with discharge gas, such as mixed gas of neon and xenon, with approx. 66500 Pa (500 Torr) of pressure. Discharge cells are formed at an intersection of address electrodes 11 and display electrodes 6 that is formed of scan electrodes 4 and sustain electrodes 5. Each of discharge cells 16 forms a unit emission area. Adjacent three discharge cells having phosphor layers 14R, 14G, 14B form one pixel.

As a typical driving operation of PDP 1, one field of an image signal is divided into a plurality of sub-fields each of which has a weight of luminance. Discharge cells 16 undergo sustain discharge the number of discharging corresponding to the weight of luminance in each sub-field. Combination of sub-fields having difference in generating discharge allows the panel to have gradational display.

Each sub-field contains a reset period, address period, and sustain period. In the reset period, reset discharge is generated to facilitate address discharge in the next address period. In the address period, address discharge is generated between scan electrodes 4 and sustain electrodes 5 to select a discharge cell to be turned ON. In the sustain period, sustain pulses are alternately applied to scan electrodes 4 and sustain electrodes 5, so that sustain discharge is generated for a predetermined period in the discharge cell selected in the address period. The number of the sustain pulses for each subfield is determined so as to correspond to the weight of luminance given to each sub-field. Through the sustain discharge, phosphor layers 14R, 14G, and 14B emit light, whereby images are shown on the panel. Controlling the light emission of the phosphor layers for each sub-field allows the panel to have gradational display.

Next will be described the manufacturing method of PDP 1.

To make front plate 2, scan electrodes 4, sustain electrodes 5, dielectric layer 7, and protective layer 8 are formed on substrate 3. On the other hand, to make back plate 9, address electrodes 11, dielectric layer 12, barrier ribs 13, and phosphor layers 14R, 14G, 14B are formed on substrate 10. Front plate 2 and back plate 9 are oppositely positioned so that scan electrodes 4 and sustain electrodes 5 are orthogonal to address electrodes 11, and then the two plates are sealed on the peripheries by glass-fritting. After that, the discharge space formed between the two plates is filled with discharge gas. PDP 1 is thus completed.

In PDP 1 just finished the process above, generally, the operating voltage—required to uniformly illuminating PDP 1—is too high, and the discharge itself is unstable. The phenomenon is believed to be due to adsorption of impurities, such as $H_2O$, $CO_2$, and hydrocarbon-based gas on the surface of protective layer 8.

Therefore, PDP 1 undergoes an aging process after the assembly process. Through the aging, the impurities are removed from the surface by sputtering of aging discharge. This can not only lower the operating voltage, but also provide discharge characteristics with consistency and stability.

Now will be described the method of aging PDPs in the first exemplary embodiment of the present invention.

Figure 2:
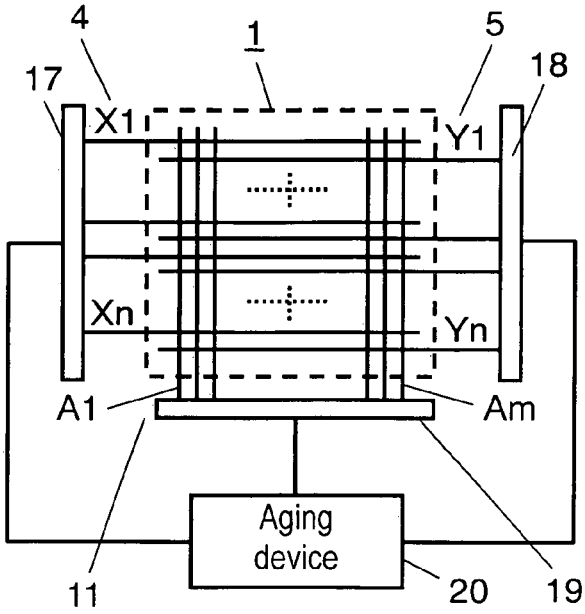
FIG. 2 is a block diagram schematically showing the structure of a plasma display panel of an embodiment when the panel undergoes the aging process.

FIG. 2 is a block diagram schematically showing the structure of PDP 1 when PDP 1 undergoes the aging process. In the aging process, scan electrodes 4 (X1, X2, . . . , Xn) are short-circuited by short-circuiting electrode 17. Sustain electrodes 5 (Y1, Y2, . . . , Yn) are short-circuited by short-circuiting electrode 18. Similarly, address electrodes 11 (A1, A2, . . . , Am) are short-circuited by short-circuiting electrode 19. Short-circuiting electrodes 17, 18, and 19 are connected to aging device 20 so that voltage and current is fed to scan electrodes 4, sustain electrodes 5, and address electrodes 11.

FIG. 3 shows voltage waveforms employed for the first embodiment. Fed from aging device 20, each waveform is applied to scan electrodes 4, sustain electrodes 5, and address electrodes 11. FIGS. 3A and 3B show the waveforms of voltage for scan electrodes 4 and sustain electrodes 5, respectively. The rectangular pulses with voltage Vs that is the pulse height at least as high as the operating voltage are alternately applied, in a period of T, to the electrodes. FIGS. 3C and 3D show the waveforms of voltage for address electrodes 11; the waveform of FIG. 3C is used in the first half of the aging period, i.e., aging-lasting period, whereas the waveform of FIG. 3D is for the last half of the aging period. In the first-half period, as shown in FIG. 3C, a negative-polarity rectangular pulse with a pulse width of time tw1 and a pulse height of voltage Vd1 is applied to address electrodes 11 with a delay of time td1 from the moment at which a rectangular pulse was applied to scan electrodes 4. In the last-half period, as shown in FIG. 3D, a negative-polarity rectangular pulse with a pulse width of time tw2 and a pulse height of voltage Vd2 is applied to address electrodes 11 with a delay of time td2 from the moment at which a rectangular pulse was applied to sustain electrodes 5. The first-half period, in which the waveform shown in FIG. 3C is applied to address electrodes 11, is defined as the first aging period; and the last-half period, in which the waveform shown in FIG. 3D is applied to address electrodes 11, is defined as the second aging period.

Here will be described the result of aging PDP 1 using the voltage waveforms shown in FIG. 3. PDP 1 used for the experiment of aging has 1028×768 pixels (i.e., m=1028×3, n=768) with a 42-inch diagonal screen. In experiment sample 1, each parameter of the voltage waveforms shown in FIG. 3 was determined as follows.

[Experiment Sample 1]
voltage Vs: 230 V
period T: 25 μs
voltage Vd1(=voltage Vd2): −100 V
time td1 (=time td2): 1-3 μs
time tw1 (=time tw2): 1.5-3 μs Parameters td1, td2, tw1, and tw2 were defined to be a fixed value within each range above. The period until 3 hours after the start of aging was defined as the first aging period, during which the voltage waveform of FIG. 3C was applied to address electrodes 11. The period after a lapse of 3 hours was defined as the second aging period, during which the voltage waveform of FIG. 3D was applied to address electrodes 11.

As a comparison sample, a PDP with the same spec as the PDP used for experiment sample 1 was tested, with parameters of voltage waveforms defined below.

[Comparison Sample 1]
voltage Vs: 230 V
period T: 25 μs

In comparison sample 1, address electrodes 11 have no application of rectangular pulses; instead, grounding voltage, that is, voltage of zero volt was applied to the electrodes for aging.

Figure 4A:
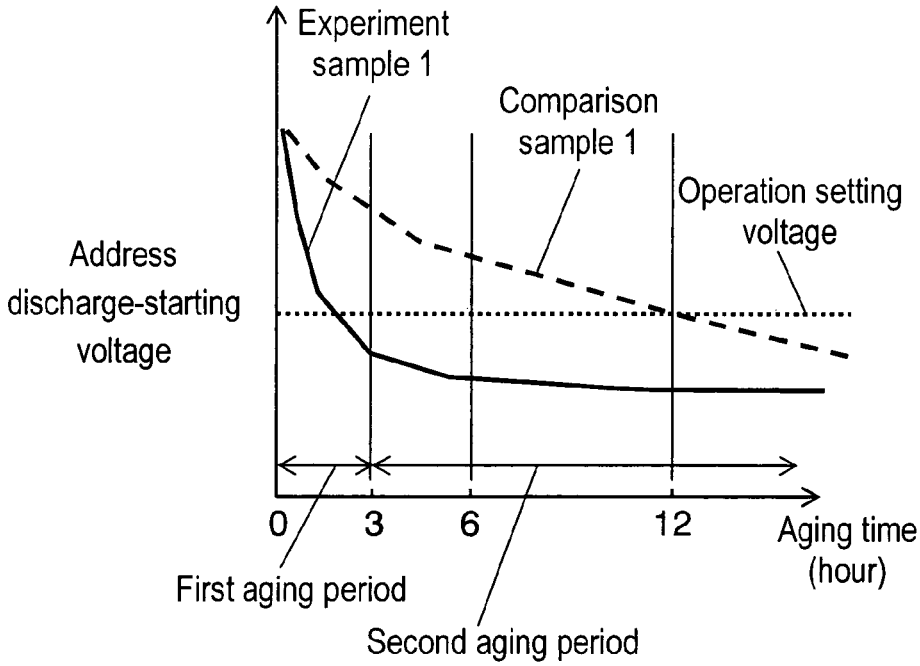
FIG. 4A shows change in address discharge-starting voltage in the aging process of the first exemplary embodiment.
Figure 4B:
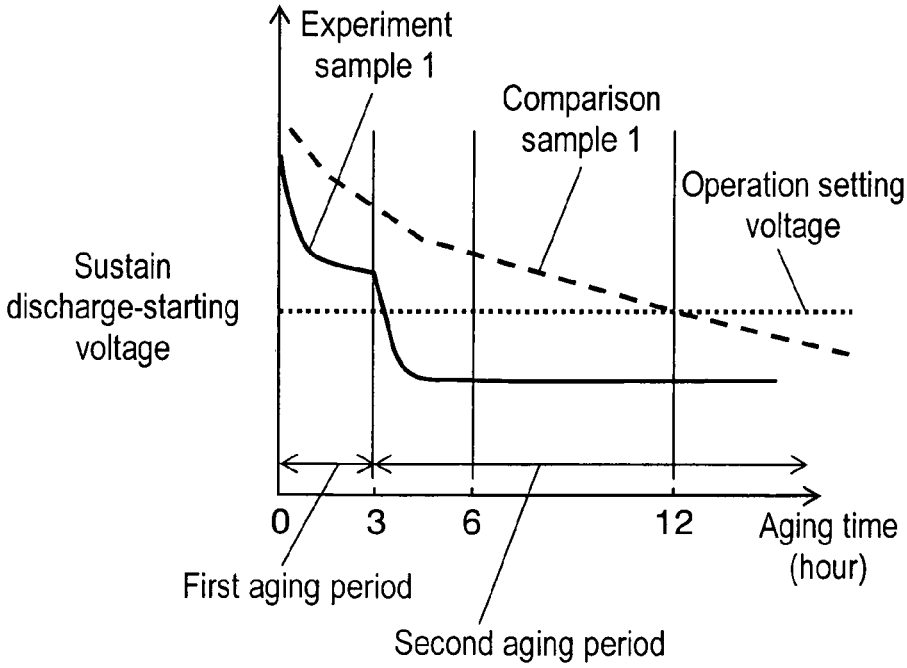
FIG. 4B shows change in sustain discharge-starting voltage in the aging process of the first exemplary embodiment.

FIG. 4 shows the results of aging the PDPs of experiment sample 1 and comparison sample 1. FIG. 4A shows change in address discharge-starting voltage as aging time goes by; similarly, FIG. 4B shows change in sustain discharge-starting voltage as aging time goes by. In the graphs, the solid line shows the result of experiment sample 1 and the broken line shows the result of comparison sample 1. FIGS. 4A and 4B also show the voltage to be applied to each electrode when images are shown on the screen (hereinafter, operation setting voltage). The address discharge-starting voltage represents the voltage at the start of the discharge generated between scan electrodes 4 and address electrodes 11; and the sustain discharge-starting voltage represents the voltage at the start of the discharge generated between scan electrodes 4 and sustain electrodes 5, both of which are important parameters in determining driving waveform for image display.

With the passage of the aging time, as shown in FIG. 4, the declining curves of the address discharge-starting voltage and the sustain discharge-starting voltage get lowered than each operation setting voltage, and finally get into a plateau. This is the end of the aging process.

In experiment sample 1, as shown in FIG. 4, the address discharge-starting voltage drops sharply just after the start of aging, and by the time when the end of the first aging period, a sign of stability is found in the curve. In the second aging period, the voltage shows a mild decrease. On the other hand, the sustain discharge-starting voltage shows a sudden fall from the start of the first aging period, and after that, the voltage shows a stability, keeping the range greater than the operation setting voltage until the end of the first aging period. Just after the start of the second aging period, however, the voltage exhibits a sharp decrease again, and after that, the voltage settles down on a level below the operation setting voltage. The result of experiment sample 1 tells that the aging completes in about 6 hours.

According to the PDP of comparison sample 1, in contrast, both the discharge-starting voltages don't reach a stable level even though having a lapse of 12 hours from the start of the aging process. That is, the aging is insufficient even after such long hours.

It is apparent from the result above that the aging method of the present invention can provide an aging process with shortened aging time and high power efficiency.

The reason why the aging time can be shortened by the aging method will be described hereinafter.

Figure 5A:
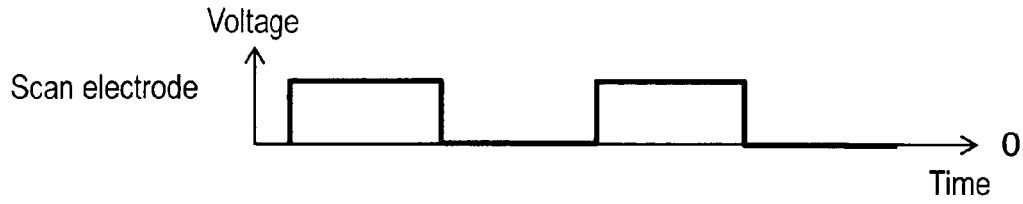
FIG. 5A shows a waveform of voltage fed from an aging device to apply the voltage to the scan electrodes.
Figure 5B:
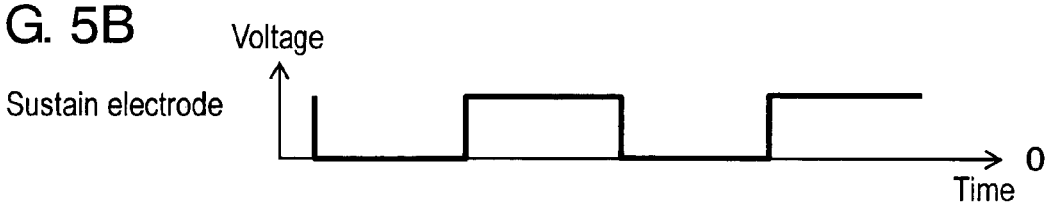
FIG. 5B shows a waveform of voltage fed from the aging device to apply the voltage to the sustain electrodes.
Figure 5C:
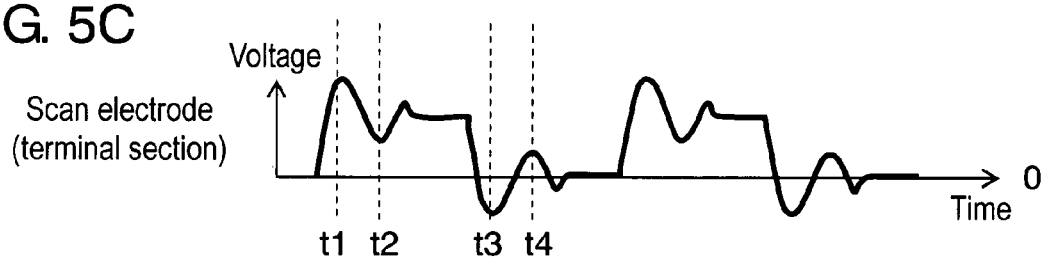
FIG. 5C shows a waveform of voltage applied to a terminal section of the scan electrodes.
Figure 5D:
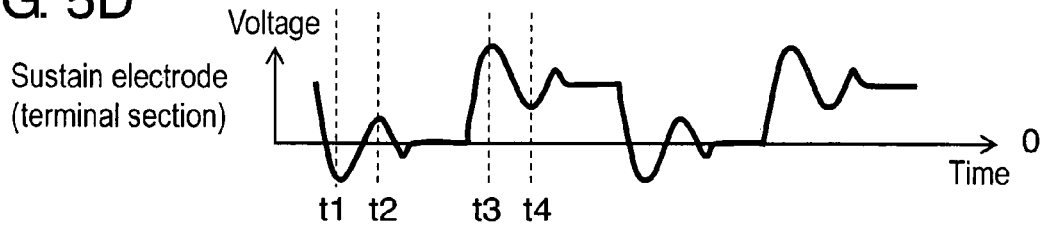
FIG. 5D shows a waveform of voltage applied to a terminal section of the sustain electrodes.

First will be described the aging process in which address electrodes 11 are grounded as is in comparison sample 1. FIGS. 5A and 5B show waveforms of voltage fed from aging device 20, which are applied to scan electrodes 4 and sustain electrodes 5, respectively, when the PDP undergoes aging. The voltage waveforms of FIG. 5A and FIG. 5B are the same as the voltage waveforms of FIGS. 3A and 3B, respectively. FIG. 5C shows the voltage waveform at the terminal of short-circuiting electrode 17 by which scan electrodes 4 of PDP 1 are short-circuited; and similarly, FIG. 5D shows the voltage waveform at the terminal of short-circuiting electrode 18 by which sustain electrodes 5 are short-circuited. The voltage actually applied to scan electrodes 4 and sustain electrodes 5, as shown in FIGS. 5C and 5D, has the waveform in which ringing is superimposed on a rectangular pulse that was originally fed from aging device 20. The ringing is brought by resonance between floating inductance of wires connecting aging device 20 and short-circuiting electrodes 17, 18 and the capacity of PDP 1. In addition to the floating inductance of wires, to control the magnitude of ringing, a coil or ferrite core is sometimes added into the wires. In practice, a waveform having a rectangular pulse train, as shown in FIG. 5A and FIG. 5B, more or less suffers ringing when the voltage is applied to each electrode.

Figure 5E:
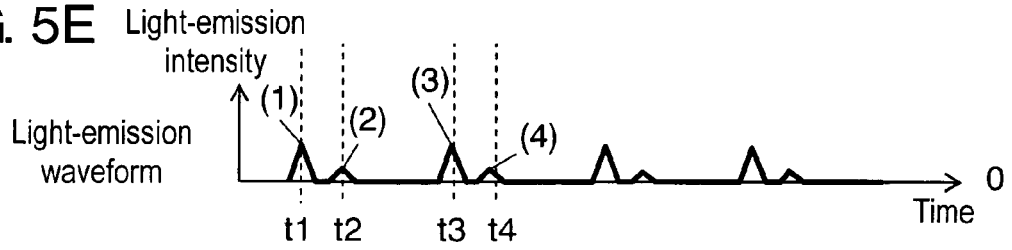
FIG. 5E shows a waveform of light emission in a discharge cell detected by a photo sensor when a PDP undergoes the aging process.
Figure 6A:
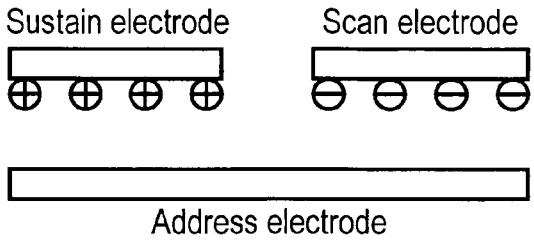
FIG. 6A shows the arrangement of wall charge after positive voltage is applied to the scan electrodes.
Figure 6B:
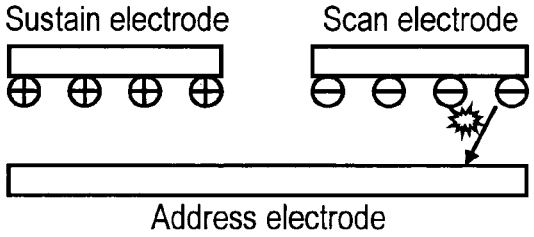
FIG. 6B shows how the discharge between the scan electrodes and the address electrodes is generated.
Figure 6C:
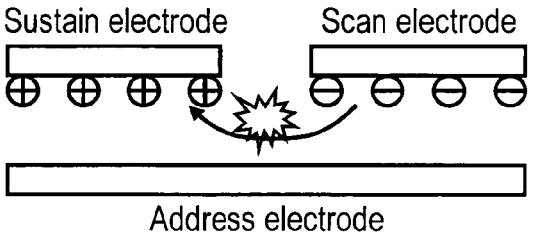
FIG. 6C shows self-erase discharge developed from the discharge between the scan electrodes and the sustain electrodes.
Figure 6D:
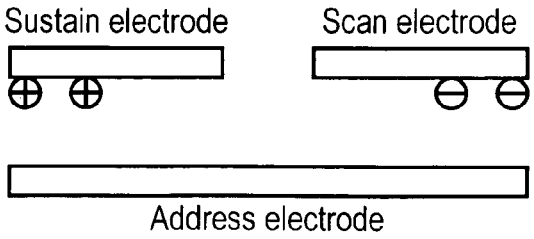
FIG. 6D shows wall charge in an outer area of the scan electrodes and the sustain electrodes.

FIG. 5E schematically shows a waveform of light-emission in a discharge cell detected by a photo sensor when a PDP undergoes the aging process. Each crest of the waveform shows the moment at which the discharge occurs. The photo sensor is employed for monitoring infrared light-emission (with a wave length of 820-830 nm) radiated from Xe atoms excited by the discharge. Therefore, the photo sensor used here was the one having a high sensitivity in the infrared area so as not to detect the light emission from phosphor layers 14R, 14G, and 14B. The major aging discharges (1) and (3) shown in FIG. 5E occur when the voltage between scan electrodes 4 and sustain electrodes 5 increases. Minor discharges (2) and (4) following aging discharges (1) and (3) occur, after the voltage between scan electrodes 4 and sustain electrodes 5 reaches the maximum, in the wake of overshoot caused by ringing. Minor discharges (2) and (4) are a self-erase discharge generated by application of inverted-polarity voltage to the aging discharges (1) and (3).

FIG. 6 illustrates how self-erase discharge occurs, schematically showing movement of wall charges collected on each electrode. In FIG. 6, some components including a dielectric layer are omitted from the structure for convenience. FIG. 6A shows the arrangement of the wall charges just after the completion of major aging discharge (1) by the application of positive voltage to scan electrodes 4. Scan electrodes 4 carry negative charges, while sustain electrodes 5 carry positive charges. At the scan electrode 4, a potential drop triggered by ringing—even if the potential drop has not enough magnitude to generate discharge between scan electrodes 4 and sustain electrodes 5—induces the discharge between scan electrodes 4 and address electrodes 11, because that the discharge between those electrodes starts at a low voltage. At this time, the discharge occurred between electrodes 4 and 11 serves as a priming discharge, which substantially decrease the voltage level at the start of the discharge between scan electrodes 4 and sustain electrodes 5, thereby inducing the discharge between scan electrodes 4 and sustain electrodes 5, as shown in FIG. 6C. Self-erase discharge (2) is thus generated. FIG. 6D shows the wall charges after completion of self-erase discharge (2). Self-erase discharge (2) decreases the amount of the wall charges, so that a large voltage is required to perform the following aging discharge (3). Besides, the wall charges do not stay on the side of the discharge gap, but in the outer area on scan electrodes 4 and sustain electrodes 5. The sputtering by positive ions in the following aging discharge concentrates on the outer area having the wall charges, so that the surface of protective layer 8 over the electrodes undergoes an uneven sputtering.

Self-erase discharge (4) occurs in a like manner: at the sustain electrodes 5, a potential drop triggered by ringing—even if the potential drop has not enough magnitude to generate discharge between scan electrodes 4 and sustain electrodes 5—induces the discharge between sustain electrodes 5 and address electrodes 11, because that the discharge between those electrodes starts at a low voltage. At this time, the discharge occurred between electrodes 5 and 11 serves as a priming discharge, which substantially decrease the voltage level at the start of the discharge between scan electrodes 4 and sustain electrodes 5, thereby inducing the discharge between scan electrodes 4 and sustain electrodes 5. Self-erase discharge (4) is thus generated.

That is, the self-erase discharge does not directly occur between scan electrodes 4 and sustain electrodes 5. The self-erase discharge is triggered by a priming discharge, which occurs between scan electrodes 4 and address electrodes 11, or between sustain electrodes 5 and address electrodes 11.

The self-erase discharge takes its name from the fact that the discharge erases the wall charges accumulated on the surface of protective layer 8 by aging discharges (1), (3). In spite of consuming electric power, the self-erase discharge has little sputtering effect by aging because the discharge occurs under a small change in voltage. Besides, the self-erase discharge erases or reduces the wall charges, which makes difficult to generate following aging discharges (1) and (3), and makes aging efficiency lower. Furthermore, the magnitude of the self-erase discharge greatly depends on the characteristics of each discharge cell; the aging time takes longer for the cell that is likely to have self-erase discharge. To perform the aging process satisfactorily for all the discharge cells, further longer aging time is required. Times t1 through t4 that show the moments at which discharges (1) through (4) in FIG. 5 are the same as times t1 through t4 in FIG. 3.

Figure 3A:
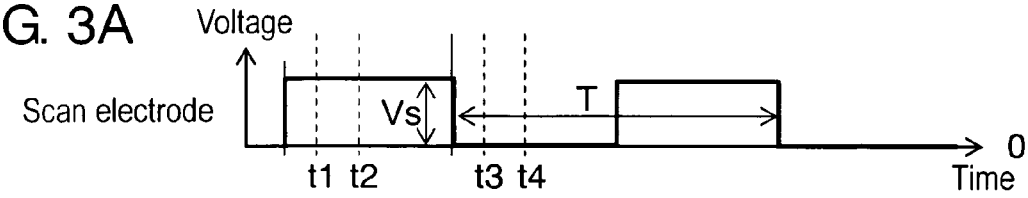
FIG. 3A shows a waveform of voltage applied to the scan electrodes in the aging process of a first exemplary embodiment of the present invention.
Figure 3B:
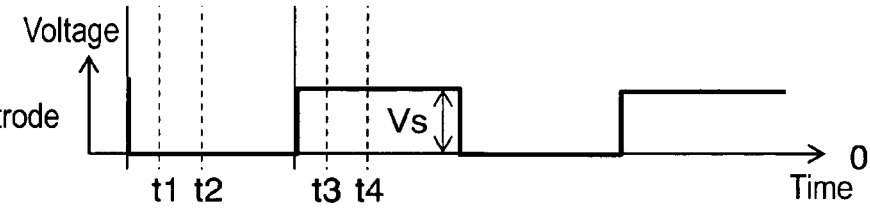
FIG. 3B shows a waveform of voltage applied to the sustain electrodes in the aging process of the first exemplary embodiment.
Figure 3C:
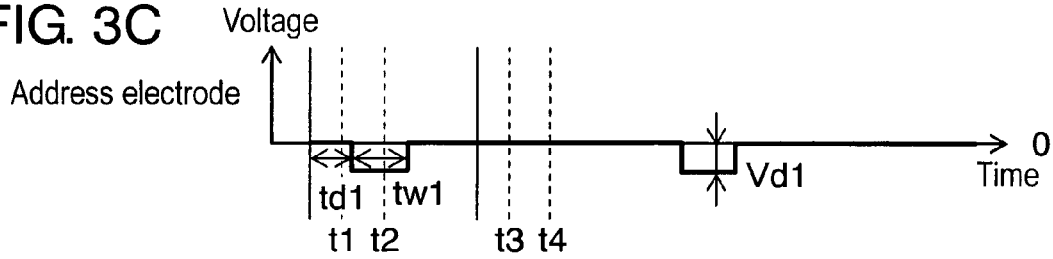
FIG. 3C shows a waveform of voltage applied to the address electrodes in the aging process of a first exemplary embodiment.

Next will be described the aging process employed for experiment sample 1, in which the rectangular pulse shown in FIG. 3C is applied to address electrodes 11. Applying voltage, which has a change in the negative direction due to ringing, to scan electrodes 4 generates self-erase discharge (2). Considering the fact above, negative voltage is applied to address electrodes 11 at the exact moment of time t2 in FIG. 3 and FIG. 5, whereby the discharge between scan electrodes 4 and address electrodes 11 is suppressed; and accordingly, self-erase discharge (2) can be suppressed. In this case, the application of voltage to address electrodes 11 can suppress the self-erase discharge that occurs in succession to the aging discharge in the wake of increase in voltage applied to scan electrodes 4 and decrease in voltage applied to sustain electrodes 5. That is, applying the rectangular pulse can suppress self-erase discharge (2) generated by the application of voltage in which scan electrodes 4 carry a voltage level higher than sustain electrodes 5. In the experiment, the intensity of self-erase discharge (2) was reduced by more than half when the voltage waveform shown in FIG. 3C was applied to address electrodes 11. This can therefore intensify the following discharge, i.e., the aging discharge generated by the application of voltage in which scan electrodes 4 carry a voltage level lower than sustain electrodes 5. In the aging discharge, positive ions moving toward the side of scan electrodes 4 provide the surface of protective layer 8 on the side of scan electrodes 4 with sputtering. This is the reason why the aging on the side of scan electrodes 4 is accelerated than that on the side of sustain electrodes 5, which works effective in lowering the address discharge-starting voltage. On the other hand, the sustain discharge-starting voltage slightly declines by sputtered protective layer 8 on the side of scan electrodes 4; however, poor sputtering on protective layer 8 on the side of sustain electrodes 5 does not contribute to a sufficiently lowered voltage level.

Figure 3D:
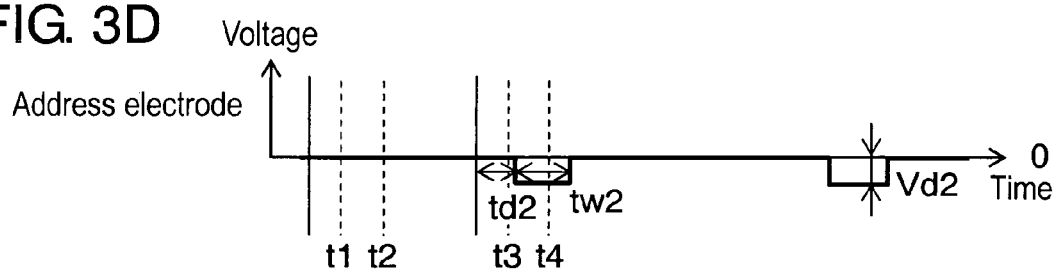
FIG. 3D shows another waveform of voltage applied to the address electrodes in the aging process of the first exemplary embodiment.
Figure 3E:
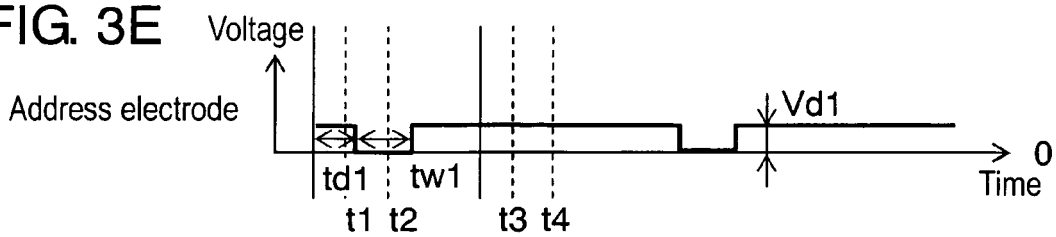
FIG. 3E shows still another waveform of voltage applied to the address electrodes in the aging process of the first exemplary embodiment.
Figure 3F:
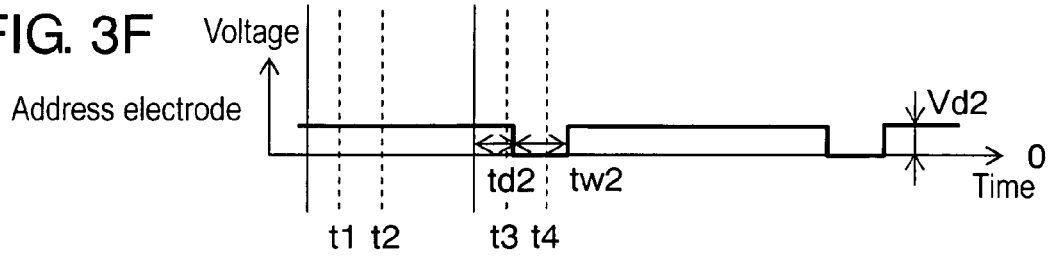
FIG. 3F shows another waveform of voltage applied to the address electrodes in the aging process of the first exemplary embodiment.

Now will be described the aging process in which the rectangular pulse shown in FIG. 3D is applied to address electrodes 11. In this case, unlike the case shown in FIG. 3C, the application of voltage to address electrodes 11 can suppress the self-erase discharge that occurs in succession to the aging discharge in the wake of increase in voltage applied to sustain electrodes 5 and decrease in voltage applied to scan electrodes 4. That is, applying voltage to the address electrode suppresses self-erase discharge (4) in the wake of application of voltage in which sustain electrodes 5 carry a voltage level higher than scan electrodes 4. In the experiment, the intensity of self-erase discharge (4) was reduced by more than half when the voltage waveform shown in FIG. 3D was applied to address electrodes 11. The application of voltage above works to provide the effect opposite to the case in FIG. 3C—the aging on the side of sustain electrodes 5 is accelerated than that on the side of scan electrodes 4. In the first aging period, protective layer 8 on the side of scan electrodes 4 has already been sputtered. With application of the rectangular pulse shown in FIG. 3D, protective layer 8 on the side of sustain electrodes 5 undergoes sputtering. This allows the sustain discharge-starting voltage to drop sharply and reach a level below the operation setting voltage.

Applying the rectangular pulses shown in FIGS. 3C and 3D to address electrodes 11 at a well-timed moment—after the waveform has experienced the pulse rise and then the maximum level of ringing, and before the self-erase discharge occurs—can suppress the self-erase discharge.

Although the rectangular pulse having the parameter setting (where, voltage Vd1=voltage Vd2; time td1=time td2; and time tw1=time tw2) is applied to address electrodes 11 in experiment 1 above, it is not limited thereto. For example, if the waveform of the ringing observed when scan electrodes 4 take the higher voltage-side differs from the waveform of the ringing observed when sustain electrodes 5 take the higher voltage-side, each parameter should be properly determined so that the intensity of the self-erase discharge is minimized. For getting more preferable effect, voltage Vs should be controlled so as to decrease with a lapse of the aging time according to the change in the sustain discharge-starting voltage.

In the embodiment, for the first-half period of the aging period, the voltage waveform of FIG. 3C is applied to address electrodes 11; and the waveform of FIG. 3D is applied to the electrodes for the last-half period. The application order is exchangeable-applying the waveform of FIG. 3D first, and then the waveform of FIG. 3C for the last-half can obtain the same effect.

As is apparent from FIGS. 4A and 4B, compared to the address discharge-starting voltage, the sustain discharge-starting voltage quickly reduces and settles in a stable condition. Considering above, the second aging period can be shorter than the first aging period. This further accelerates the aging time.

In AC-type PDP 1, each electrode is isolated from the discharge space, since the electrodes are covered with the dielectric layers. Therefore, a direct voltage component has no contribution to the discharge itself. The application of negative voltage to address electrodes 11 within a predetermined period including the moment of the occurrence of the self-erase discharge has the same effect as the application of positive voltage to address electrodes 11 in a period except for the predetermined period. That is, applying the waveform of FIG. 3E instead of the waveform of FIG. 3C, and the waveform of FIG. 3F instead of the waveform of FIG. 3D to address electrodes 11 offers the same effect.

Second Exemplary Embodiment

FIG. 7 shows the voltage waveforms used for the aging method of the second exemplary embodiment of the present invention. Employing the waveforms can suppress the self-erase discharge, thereby providing an effective aging, as well as the waveforms shown in FIG. 3. FIG. 7A and FIG. 7B show the waveforms of voltage applied to scan electrodes 4 and sustain electrodes 5, respectively. FIG. 7C and FIG. 7D show the waveforms of voltage applied to address electrodes 11. All of them are fed from aging device 20. Time t1 through time t4 in FIG. 7 exactly correspond to time t1 through time t4 in FIG. 3, and time t1 through time t4 in FIG. 5.

Figure 7A:
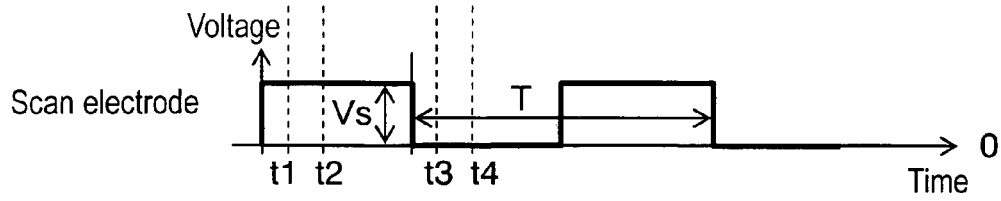
FIG. 7A shows a waveform of voltage applied to the scan electrodes in the aging process of a second exemplary embodiment of the present invention.
Figure 7B:
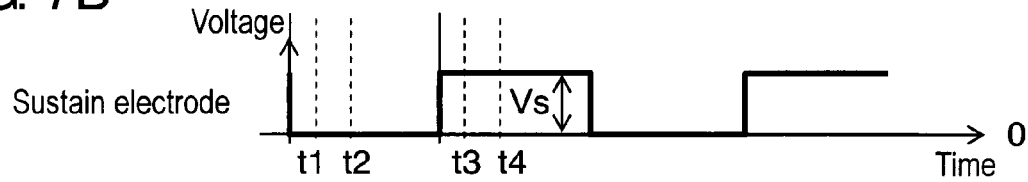
FIG. 7B shows a waveform of voltage applied to the sustain electrodes in the aging process of the second exemplary embodiment.
Figure 7C:
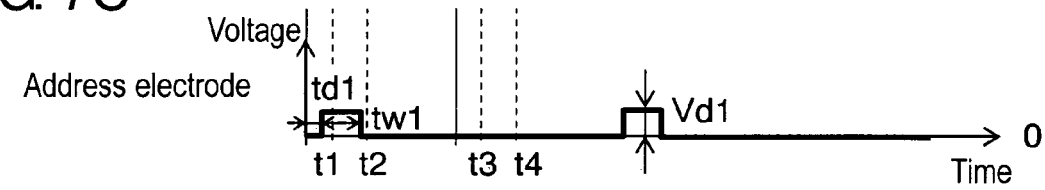
FIG. 7C shows a waveform of voltage applied to the address electrodes in the aging process of the second exemplary embodiment.
Figure 7D:
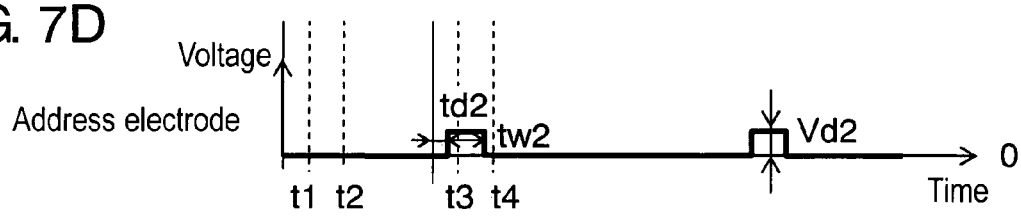
FIG. 7D shows another waveform of voltage applied to the address electrodes in the aging process of the second exemplary embodiment.

Applying the waveform of FIG. 7C to the address electrode can suppress, as is the waveform of FIG. 3C, the self-erase discharge that occurs in succession to the aging discharge in the wake of increase in voltage applied to scan electrodes 4 and decrease in voltage applied to sustain electrodes 5. That is, the waveform is effective in suppressing the self-erase discharge generated by application of voltage in which scan electrodes 4 carry a voltage level higher than sustain electrodes 5. On the other hand, the waveform of FIG. 7D can suppress, as is the waveform of FIG. 3D, the self-erase discharge that occurs in succession to the aging discharge in the wake of increase in voltage applied to sustain electrodes 5 and decrease in voltage applied to scan electrodes 4. That is, the waveform is effective in suppressing the self-erase discharge generated by application of voltage in which sustain electrodes 5 carry a voltage level higher than scan electrodes 4. With the waveforms shown in FIG. 7C and FIG. 7D, the self-erase discharge can be properly suppressed. That is, applying the waveform in the drawings above increases the voltage level of address electrodes 11 according to a rise of ringing waveform applied to scan electrodes 4 or sustain electrodes 5, and decreases the voltage level of address electrodes 11 when scan electrodes 4 or sustain electrodes 5 undergo a drop of voltage after the voltage exhibited the maximum level of the ringing waveform.

Next will be described the result of aging PDP 1 using the voltage waveforms shown in FIG. 7. PDP 1 employed for experiment sample 2 is the same as the PDP used as experiment sample 1. In experiment sample 2, each parameter of the voltage waveforms shown in FIG. 7 was determined as follows.

[Experiment Sample 2]
voltage Vs: 230 V
period T: 25 μs
voltage Vd1(=voltage Vd2): 100 V
time td1 (=time td2): 0-1 μs
time tw1 (=time tw2): 1-3 μs Parameters td1, td2, tw1, and tw2 were defined to be a fixed value within each range above. The period until 3 hours after the start of aging was defined as the first aging period, during which the voltage waveform of FIG. 7C was applied to address electrodes 11. The period after a lapse of 3 hours was defined as the second aging period, during which the voltage waveform of FIG. 7D was applied to address electrodes 11. From the result of the experiment, the address discharge-starting voltage and the sustain discharge-starting voltage showed decreasing curves similar to the graphs of FIG. 4A and FIG. 4B.

Like the parameter setting in the first exemplary embodiment, if the waveform of the ringing observed when scan electrodes 4 take the higher voltage-side differs from the waveform of the ringing observed when sustain electrodes 5 take the higher voltage-side, each parameter should be properly determined so that the intensity of the self-erase discharge is minimized. For getting more preferable effect, voltage Vs should be controlled so as to decrease with a lapse of the aging time according to the change in the sustain discharge-starting voltage.

Third Exemplary Embodiment

FIG. 8 shows the voltage waveforms used in the aging method of the third exemplary embodiment of the present invention. These are the waveforms before ringing is superimposed thereon. Employing the waveforms can suppress the self-erase discharge, thereby providing an effective aging, as well as the waveforms shown in FIG. 3.

Figure 8A:
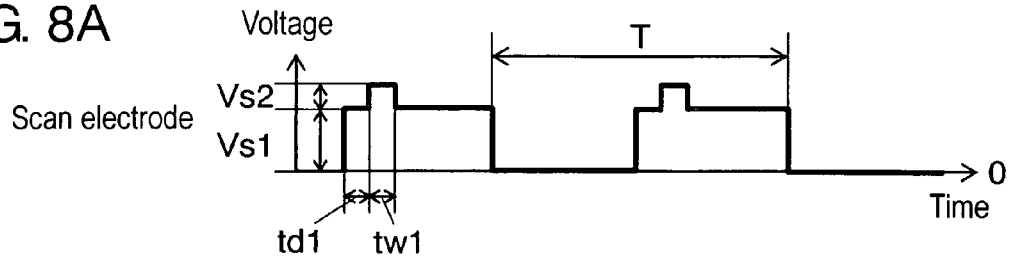
FIG. 8A shows a waveform of voltage applied to the scan electrodes in the aging process of a third exemplary embodiment of the present invention.
Figure 8B:
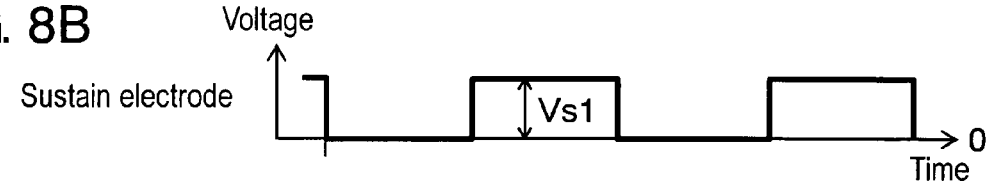
FIG. 8B shows a waveform of voltage applied to the sustain electrodes in the aging process of the third exemplary embodiment.
Figure 8C:
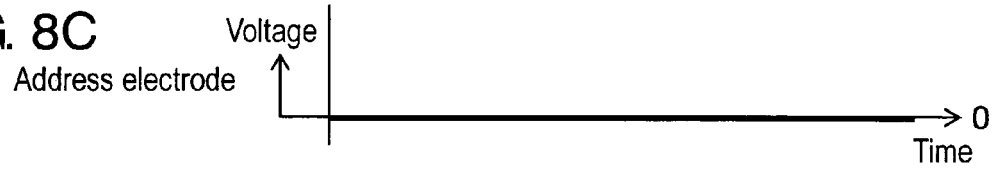
FIG. 8C shows a waveform of voltage applied to the address electrodes in the aging process of the third exemplary embodiment.
Figure 8D:
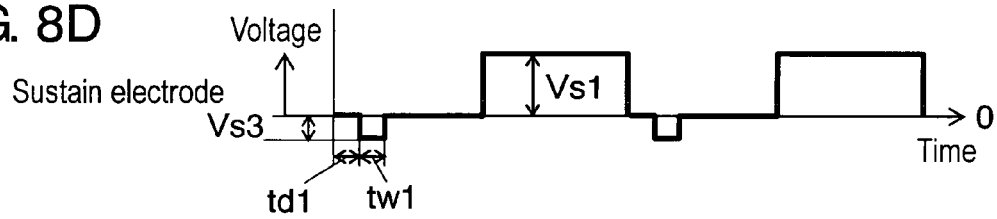
FIG. 8D shows a waveform of voltage applied to the sustain electrodes in the aging process of the third exemplary embodiment.

FIGS. 8A, 8B, and 8C show the waveforms to suppress the self-erase discharge that occurs in succession to the aging discharge caused by application of voltage in which the scan electrode carries a voltage level higher than the sustain electrode. Specifically, FIG. 8A shows the waveform applied to scan electrodes 4; the waveform of FIG. 8B is for sustain electrodes 5; and the waveform of FIG. 8C is for address electrodes 11. According to the waveform shown in FIG. 8A, the voltage level is increased by voltage Vs2 at the very moment when ringing is superimposed on the waveform applied to scan electrodes 4. By virtue of the increase by voltage Vs2, voltage drop due to the ringing can be suppressed, whereby the self-erase discharge can be minimized. Applying the waveform of FIG. 8D to sustain electrodes 5, instead of the waveform of FIG. 8B, can lower, by voltage Vs3, the ringing-added voltage waveform that is applied to sustain electrodes 5, thereby enhancing the effect of suppressing the self-erase discharge.

Figure 8E:
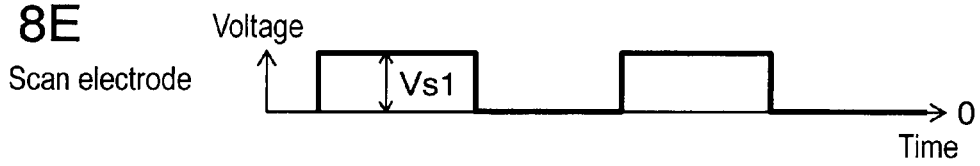
FIG. 8E shows another waveform of voltage applied to the scan electrodes in the aging process of the third exemplary embodiment.
Figure 8F:
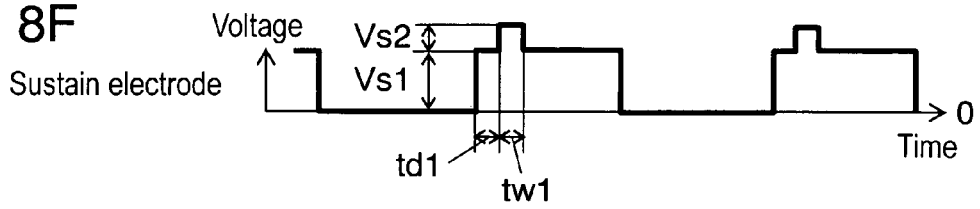
FIG. 8F shows another waveform of voltage applied to the sustain electrodes in the aging process of the third exemplary embodiment.
Figure 8G:
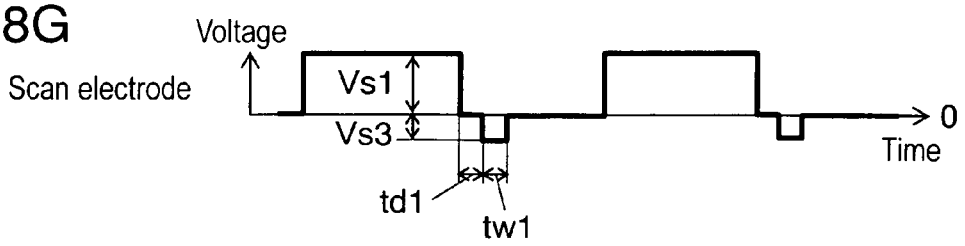
FIG. 8G shows another waveform of voltage applied to the scan electrodes in the aging process of the third exemplary embodiment.

FIGS. 8C, 8E, and 8F show the waveforms to suppress the self-erase discharge that occurs in succession to the aging discharge caused by application of voltage in which the sustain electrode carries a voltage level higher than the scan electrode. Specifically, FIG. 8E shows the waveform applied to scan electrodes 4; the waveform of FIG. 8F is for sustain electrodes 5; and the waveform of FIG. 8C is for address electrodes 11. According to the waveform shown in FIG. 8F, the voltage level is increased by voltage Vs2 at the very moment when ringing is superimposed on the waveform applied to sustain electrodes 5. By virtue of the increase by voltage Vs2, voltage drop due to the ringing can be suppressed, whereby the self-erase discharge can be minimized. Applying the waveform of FIG. 8G to scan electrode 4, instead of the waveform of FIG. 8E, can lower, by voltage Vs3, the ringing-added voltage waveform that is applied to scan electrodes 4, thereby enhancing the effect of suppressing the self-erase discharge.

Next will be described the result of aging PDP 1 using the voltage waveforms shown in FIG. 8. PDP 1 employed here is the same as the PDP used as experiment sample 1. In experiment sample 3, each parameter of the voltage waveforms shown in FIG. 8 was determined as follows.

[Experiment Sample 3]
voltage Vs1: 190-230 V
voltage Vs2: 50-120 V
voltage Vs3: 0-120 V
time td1: 1-3 μs
time tw1: 1.5-3 μs
period T: 25 μs The period until 3 hours after the start of aging was defined as the first aging period, during which the voltage waveforms of FIGS. 8A, 8B, and 8C were applied to each electrode. The period after a lapse of 3 hours was defined as the second aging period, during which the voltage waveforms of FIGS. 8E, 8F, and 8C were applied to each electrode. From the result of the experiment, the address discharge-starting voltage and the sustain discharge-starting voltage showed decreasing curves similar to the graphs of FIG. 4A and FIG. 4B.

In the first and the second embodiments, the values of voltage Vd1 and Vd2, which are the pulse height of the rectangular pulse applied to address electrodes 11, should not exceed voltage Vs that is the pulse height of the rectangular pulse applied to scan electrodes 4 and sustain electrodes 5 so as not to adversely affect the discharge between scan electrodes 4 and sustain electrodes 5.

Although the frequency of the voltage applied to each electrode is determined to be 40 kHz in the first through third embodiments, it is not limited thereto. The frequency can be determined ranging from a few to 100 kHz. Each parameter (i.e., the voltage value, the width of the rectangular pulse, and the like) can be determined to an optimum value according to the structure of each PDP.

According to the experiment results in the second and third embodiments, like the result described in the first exemplary embodiment, compared to the address discharge-starting voltage, the sustain discharge-starting voltage quickly reduces and settles in stable conditions. Considering the fact, the second aging period can be shorter than the first aging period, which further accelerates the aging time.

The present invention thus offers an improved method of aging PDPs capable of shortening the aging time with high power-efficiency.

INDUSTRIAL APPLICABILITY

The present invention, as described above, offers a power-efficient aging process with the aging time accelerated. It is greatly useful for aging PDPs.

The invention claimed is:

1. A method of aging a plasma display panel having scan electrodes, sustain electrodes, and address electrodes, in which voltage is applied to at least the scan electrodes and the sustain electrodes, said method comprising:

a first aging period in which aging is carried out by applying voltages alternately and continuously to the scan electrodes and the sustain electrodes, and in which at least any one of the scan electrodes, the sustain electrodes, and the address electrodes undergo an application of voltage for suppressing a first self-erase discharge, which is a self-erase discharge that follows an aging discharge, only when the scan electrodes carry a voltage level higher than the sustain electrodes; and a second aging period in which aging is carried out by applying voltages alternately and continuously to the scan electrodes and the sustain electrodes, and in which at least any one of the scan electrodes, the sustain electrodes, and the address electrodes undergo an application of voltage for suppressing a second self-erase discharge, which is a self-erase discharge that follows an aging discharge, only when the sustain electrodes carry a voltage level higher than the scan electrodes.

2. The method of aging a plasma display panel of claim 1, wherein the second aging period lasts shorter than the first aging period.

* * * * *